US007027723B2

(12) United States Patent
Henderson et al.

(10) Patent No.: US 7,027,723 B2
(45) Date of Patent: Apr. 11, 2006

(54) WATER HEATER ELECTRICAL ENCLOSURE INSERT/FOAM DAM

(75) Inventors: David L. Henderson, Millbrook, AL (US); Jozef Boros, Montgomery, AL (US); Kenneth J. Hicks, Deatsville, AL (US)

(73) Assignee: Rheem Manufacturing Company, New York, NY (US)

( * ) Notice: Subject to any disclaimer, the term of this patent is extended or adjusted under 35 U.S.C. 154(b) by 19 days.

(21) Appl. No.: 10/887,583

(22) Filed: Jul. 9, 2004

(65) Prior Publication Data

US 2005/0002661 A1 Jan. 6, 2005

Related U.S. Application Data

(62) Division of application No. 10/611,481, filed on Jul. 1, 2003, now Pat. No. 6,917,756.

(51) Int. Cl.
*F24H 1/18* (2006.01)

(52) U.S. Cl. ..... 392/441; 392/449

(58) Field of Classification Search ..... None
See application file for complete search history.

(56) References Cited

U.S. PATENT DOCUMENTS

| | | | | |
|---|---|---|---|---|
| 2,642,851 A | | 6/1953 | McFerran | 122/494 |
| 3,253,731 A | | 5/1966 | Fink et al. | 220/9 |
| 4,744,488 A | | 5/1988 | Nelson | 220/444 |
| 4,905,865 A | | 3/1990 | Yamamoto | 220/467 |
| 5,052,346 A | | 10/1991 | Beck | 122/494 |
| 5,163,119 A | | 11/1992 | Windon | 392/449 |
| 5,292,464 A | | 3/1994 | Hanning et al. | 264/46.5 |
| 5,293,844 A | | 3/1994 | Threatt | 122/494 |
| 5,299,280 A | * | 3/1994 | Ruark | 122/19.2 |
| 5,474,202 A | | 12/1995 | Moore, Jr. | 220/444 |
| 5,899,198 A | | 5/1999 | Bradenbaugh | 126/361 |

* cited by examiner

*Primary Examiner*—Thor S. Campbell
(74) *Attorney, Agent, or Firm*—Konneker & Smith, P.C.

(57) ABSTRACT

Electrical components projecting outwardly from the storage tank portion of an electric water heater are shielded from foam insulation material being injected into an insulation space between the tank and an outer jacket portion of the water heater by a hollow, open sided foam dam structure extending through a jacket opening and circumscribing the electrical components. Force exerting projections on the dam engage the interior side surface of the jacket and forcibly hold the inner side of the dam structure in sealing engagement with the tank. The projections also hold an outer side peripheral lip of the dam in a an outwardly and resiliently deflected orientation in which it is sealingly pressed inwardly against the outer side surface of the jacket around the periphery of the opening therein to prevent injected foam from being forced outwardly through the jacket opening.

30 Claims, 14 Drawing Sheets

WATER HEATER ELECTRICAL ENCLOSURE INSERT/FOAM DAM

CROSS-REFERENCE TO RELATED APPLICATION

This application is a division of U.S. application Ser. No. 10/611,481 filed on Jul. 1, 2003 now U.S. Pat. No. 6,917,756 and entitled "WATER HEATER ELECTRICAL ENCLOSURE INSERT/FOAM DAM", such prior application being incorporated by reference herein in its entirety.

BACKGROUND OF THE INVENTION

The present invention generally relates to water heaters and, in illustrated embodiments thereof, more particularly relates to a specially designed foam dam structure used to shield electrical or other types of components or structures projecting outwardly from the storage tank portion of the water heater from insulating foam injected into an insulation space surrounding the tank and disposed between the tank and an outer metal jacket portion of the water heater.

Modern water heaters of both the electric and fuel-fired type typically include a storage tank portion adapted to hold a quantity of water, previously heated by a heating system portion of the water heater, for on-demand supply to various plumbing fixtures such as sinks, tubs, showers and the like. To improve the thermal efficiency of the water heater, and lower its energy usage cost, the tank is typically insulated by injecting a hardenable, initially liquid foam insulation material into an insulation space that outwardly surrounds the tank and is disposed between the outer tank surface and a metal jacket structure spaced outwardly apart from the tank.

Various electrical components, such as thermostats and electric heating elements, or other types of structures such as pipe coupling fittings, typically project outwardly from the exterior side surface of the tank and underlie one or more jacket openings that provide access to such electrical components or other structures. Because the electrical components or other outwardly projecting structures are disposed within the insulation space surrounding the tank, they must be appropriately protected from exposure to liquid foam insulation being injected into the insulation space. Additionally, each jacket opening must be appropriately sealed at its periphery to prevent injected liquid insulation foam material from being forced outwardly through the jacket openings.

A commonly utilized approach to shielding an electrical component, or other structure projecting outwardly from the tank, from liquid insulation being forced into the jacket/tank insulation space, and to prevent injected foam from being forced outwardly through the associated jacket opening overlying the electrical component or other structure, is to install a shielding/sealing structure commonly referred to as a foam dam. The typical foam dam is basically a hollow structure having opposite open inner and outer sides and which is installed within the jacket/tank insulation space, around the electrical component or other structure which underlies the jacket opening, in a manner causing the dam to circumscribe the electrical component or other structure, the open inner side of the dam to form a seal against the tank, and the open outer side of the dam to seal around the periphery of the associated tank opening. During the subsequent injection of the liquid foam insulation into the jacket/tank insulation space the installed dam structure sealingly shields the electrical component or other structure from contact with the incoming foam and also prevents the pressurized foam from being forced outwardly through the jacket opening.

Conventional foam dams of this general type have associated therewith a variety of problems, limitations and disadvantages. One previously proposed technique for shielding structures projecting outwardly from a water heater tank into the jacket/tank insulation area, and for preventing injected insulation leakage outwardly through the associated jacket opening, is to carefully fit a fiberglass block structure against the tank exterior around the structure to be shielded from injected insulation, and then install the jacket structure over the outer side of the block. During subsequent injection of the insulating foam the fiberglass block serves as a barrier within the enclosed insulating space to prevent the foam from being forced out through the jacket structure opening or into contact with the outwardly projecting structure being shielded by the block.

While this is a relatively simple and straightforward approach to forming foam stop barriers, it has two primary disadvantages. First, the fiberglass block must be very carefully sized to sealingly extend between the outer surface of the water heater storage tank and the inner surface of the jacket structure. If even a slight gap exists around the installed block it can easily permit the injected foam to escape from the jacket structure and/or come into contact with the outwardly projecting structure shielded by the block. Second, the fiberglass block, which tends to be relatively large, typically has a thermal insulation value substantially less than that of the insulating foam. Accordingly, relative to the foam insulation, the fiberglass block forms a relatively low resistance heat outflow path in the assembled water heater. As energy conservation goals and standards continue to increase, this situation becomes less and less acceptable.

Another method conventionally used to form a foam stop barrier around an electrical component or other structure projecting outwardly from a water heater storage tank is to construct a relatively flat, foam-filled bag having one or more openings therein through which the outwardly projecting structure to be shielded may be extended, taping the bag blanket-like to the tank exterior, and then installing the outer jacket structure over the bag. Since the bags are filled with foam insulation, they do not present the heat leak problem that the fiberglass blocks do. However, like the fiberglass blocks, the foam filled bags present the potential problem of injected foam leakage past the bags if they are not carefully sized and properly fitted into place within the enclosed insulation space before the foam injection process is initiated. Additionally, the bags are rather tedious and time consuming to fabricate and install, thus undesirably increasing the overall construction cost of the water heater.

In the water heater foam dam illustrated and described in U.S. Pat. No. 5,163,119 to Windon a hollow foam dam structure is provided which is insertable through a jacket opening to circumscribe electrical components which are to be shielded from subsequently injected insulating foam material. A separate component, namely an outer metal door secured to the jacket over the installed dam, compresses an outer side lip portion of the dam inwardly against the jacket to create the necessary seal between the dam and the jacket opening periphery. This outer door is installed over the dam, prior to initiating the insulation foaming process, to effect a tight seal between the lip of the dam and the jacket.

Additionally, in the foam dam illustrated and described in this patent it is necessary to use yet a second separate component, namely a cap which is wedged in and covers the open outer side of the installed dam, to provide the installed dam with sufficient rigidity around the entire circumference of the dam walls to adequately resist undesirable leak-creating deformation thereof caused by insulation injection pressure forces.

In view of the foregoing it can be readily seen that it would be desirable to provide a foam dam structure and associated installation methods which eliminate or at least substantially reduce at least some of the above-mentioned problems, limitations and disadvantages associated with conventional foam dam structures and installation methods of the types generally described above.

SUMMARY OF THE INVENTION

In carrying out principles of the present invention, in accordance with representative illustrated embodiments thereof, liquid heating apparatus is provided which is representatively in the form of an electric water heater having a cylindrical tank for holding water, a heating system for heating the water, and a cylindrical jacket wall outwardly circumscribing the tank and defining therewith an annular insulation space between the tank and the jacket wall, the jacket wall having an access opening therein. Underlying the jacket wall opening are electrical components which project outwardly from the tank. To shield these electrical components from foam insulation subsequently injected into the insulation space, and to prevent the injected foam from being forced outwardly through the jacket opening, a specially designed insert/foam dam structure is provided which is insertable into the insulation space via the jacket wall opening.

The foam dam structure, in a representative one piece embodiment thereof, includes a hollow, representatively rectangular body portion having opposite open outer and inner sides spaced apart along an axis circumscribed by the body portion, a first sealing portion laterally projecting outwardly from the open outer side of the body, a second sealing portion on the open inner side of the body portion, and a force exerting portion.

The foam dam axially extends through the jacket wall opening with the first sealing portion overlying an outer side portion of the jacket wall extending peripherally around the jacket wall opening, the second sealing portion overlying an outer surface portion of the tank around the electrical components, and the force exerting portion engaging an inner side portion of the jacket wall in a manner inwardly forcing the first and second sealing portions into respective sealing engagement with the outer side portion of the jacket wall and the outer surface portion of the tank. The tank/dam seal could be effected in another manner if desired.

According to one aspect of the invention the first sealing portion is an axially inwardly sloped peripheral sealing lip which, in response to operative insertion of the foam dam inwardly through the jacket opening, is axially outwardly and resiliently deflected and brought into sealing engagement with the outer side surface of the jacket wall. To facilitate the use of the foam dam with cylindrical jacket walls of different diameters, first opposite side portions of the sealing lip are provided with greater axial slopes that second opposite side portions thereof.

In one version of the foam dam, the locking/force exerting structure is defined by a plurality of external projections integrally formed on wall portions of the foam dam body and spaced apart around the foam dam axis. Illustratively these external projections have generally triangular shapes which permit the foam dam to be snap-fitted through the jacket opening to the operative tank/jacket sealing orientation of the foam dam.

In other versions of the foam dam the integral external projections of the foam dam body are replaced with side wall openings, and separate locking/force exerting members are provided. To install any of these foam dam versions, the foam dam body portion is manually pressed axially inwardly through the jacket opening to a position in which the tank and jacket seals are formed, and the body wall openings are disposed inwardly of the periphery of the jacket wall openings.

With the installer still forcibly holding the inserted foam dam in its sealing orientation, the particular locking/force exerting members are then snap-fitted to or otherwise installed on a portion of the inserted foam dam in a manner causing portions of the installed locking/force exerting members to project outwardly through the body wall openings and define the external projections on the inserted foam dam. The installer then releases the inserted foam dam to bring these external projections into seal-maintaining contact with the inner side surface of the jacket wall.

The foam dam may also be of a two piece, snap-together construction comprising an axially inner body portion and an axially outer body portion. Illustratively, the inner body portion is insertable through the jacket opening and is provided with locking projections which hold the inserted inner body portion within the jacket portion with the second sealing portion, carried by the inner body portion, being sealingly compressed against the tank. After the inner body portion is installed, the outer body portion is snap-fitted to the inner body portion in a manner causing the peripheral sealing lip, which is carried by the outer body portion, to be axially outwardly and resiliently deflected and brought into sealing engagement with the outer side surface of the jacket wall. These snap-together axially outer and inner body portions may be provided with interlocking structures to brace the assembled foam dam against undesirable deflection caused by foam injection pressure forces exerted thereon.

While the representative foam dam embodiments are illustratively used in conjunction with an electric water heater, it will readily be appreciated by those of skill in this particular art that they could be also advantageously utilized with fuel-fired water heaters as well as with various other types of foam insulated liquid heating apparatus. Additionally, while the foam dam embodiments are illustrated and described herein as being utilized in the shielding of electrical components, they could also be used in the shielding of a variety of other types of structures (such as pipe couplings or other mechanical structures) projecting outwardly from the tank or other type of fluid containing vessel into the insulation space. Further, while the shapes of the illustrated foam dam embodiments are representatively rectangular they could, of course, have a variety of other shapes including, but not limited to, round, square and other polygonal shapes if desired or necessary.

DETAILED DESCRIPTION

Figure 1:
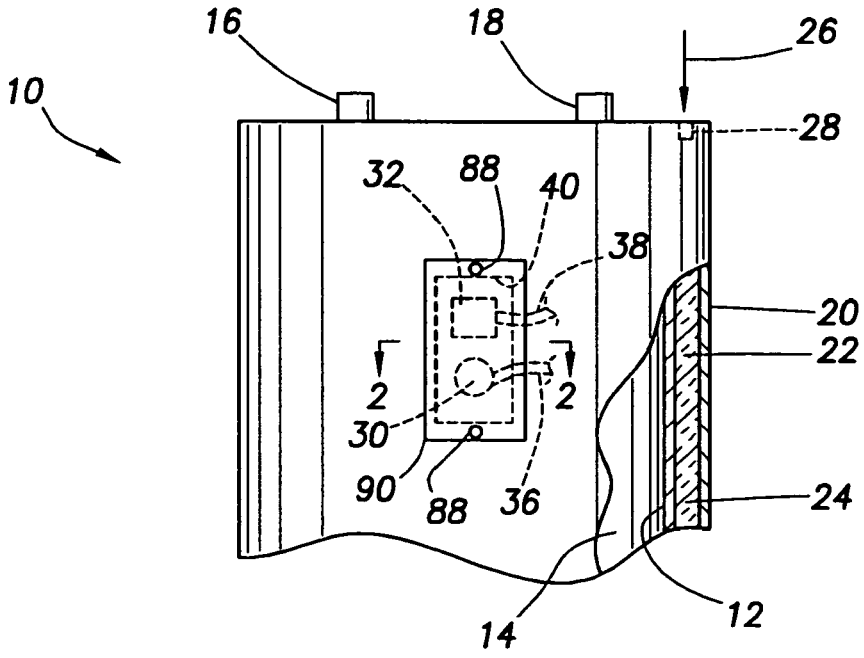
FIG. 1 is a schematic, partially sectioned side elevational view of a representative water heater incorporating therein a specially designed insulation dam structure, illustratively in the form of an electrical enclosure insert, embodying principles of the present invention.
Figure 2:
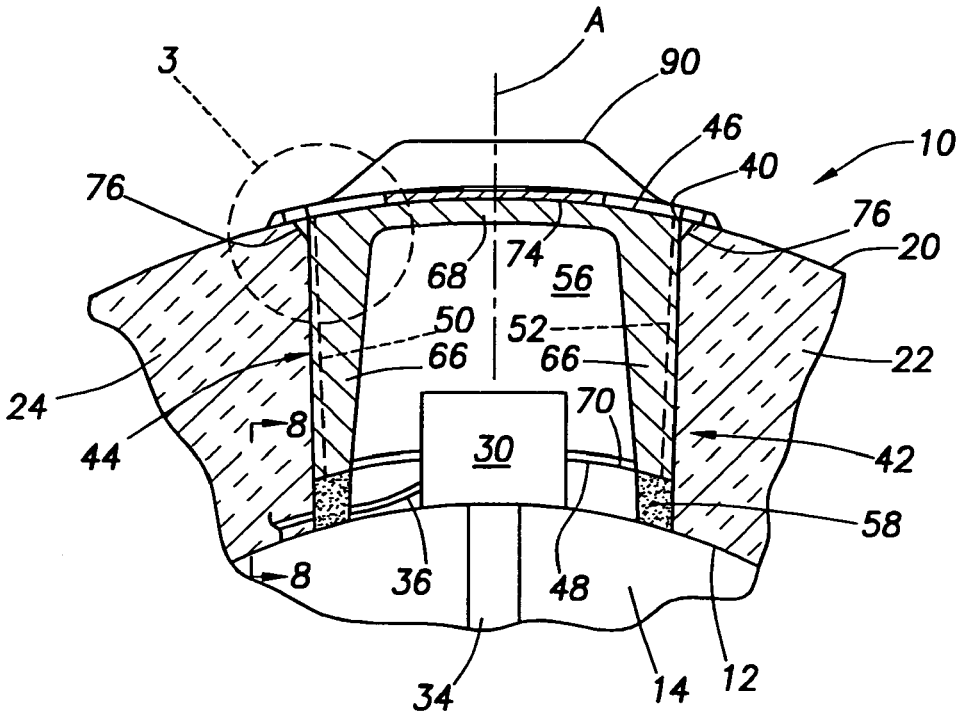
FIG. 2 is an enlarged scale partial cross-sectional view through the water heater taken generally along line 2—2 of FIG. 1.

With initial reference to FIGS. 1 and 2, this invention provides liquid heating apparatus which is representatively in the form of an electric water heater 10 having a tank 12 in which a quantity of heated water 14 is stored for on-demand delivery to plumbing fixtures such as sinks, showers, tubs, dishwashers and the like, the tank 12 having cold water inlet and hot water outlet fittings 16 and 18 which are representatively at its top end, but could alternatively be on a side wall portion thereof. Illustratively, tank 12 has a vertically oriented, cylindrical configuration. Outwardly circumscribing the tank 12 is a cylindrical outer jacket wall 20 which defines around the tank 12 an annular insulation space 22 which is filled with a hardened foam insulation material 24. During construction of the water heater 10, the insulation 24 is injected in pressurized liquid form into the insulation space 22, as indicated by the arrow 26, via a suitable injection port 28. Subsequent to this injection process the insulation 24 hardens in place within the insulation space 22.

The stored water 14 is maintained at a predetermined elevated temperature by a heating system which representatively includes (among other system components and controls) two schematically depicted electrical components—an electrical resistance type immersion heating element 30, and a thermostat 32 controllingly coupled to the heating element 30. Electrical components 30,32 are mounted on the exterior side surface of the tank 12 and projects outwardly therefrom, with the heating element 30 having a heating rod portion 34 (see FIG. 2) extending into the water 14 within the tank 12. Electrical power is respectively supplied to the heating element 30 and the thermostat 32 by wiring 36,38 extending along the exterior side surface of the tank 12 and connected to the heating element 30 and the thermostat 32.

Electrical components 30,32 underlie a representatively rectangular opening 40 formed in the outer jacket wall 20 to provide access to such electrical components. Referring now to FIGS. 1–7, the portions of the electrical components 30,32 which project outwardly from the outer surface of the tank 12 are shielded from the pressurized liquid foam insulation 24, as it is being injected into the jacket/tank insulation space 22, by a specially designed electrical enclosure insert/foam dam structure 42 which is operatively inserted inwardly through the jacket access opening 40 prior to the insulation foaming process in a manner such that the inserted foam dam 42 shieldingly circumscribes the outwardly projecting electrical component portions. As will be later described herein, the installed foam dam 42 forms a seal on the external tank surface around the electrical components 30,32 and also forms a seal around the exterior surface periphery of the jacket opening 40 to prevent the injected liquid is foam from being forced outwardly through the jacket opening.

Foam dam 42 has a hollow molded plastic rectangular body 44 that circumscribes an axis A and has open outer and inner sides 46 and 48, opposite side walls 50 and 52, and opposite end walls 54 and 56. Open inner side 48 is concavely curved. A resilient sealing strip 58, representatively formed from a foam rubber material, is suitably secured to and projects downwardly (as viewed in FIG. 4) from the peripheral edge of the open inner side 48. A resiliently deflectable exterior peripheral sealing lip 60 laterally projects outwardly from the open outer side 46 of the foam dam body 44.

Figure 6:
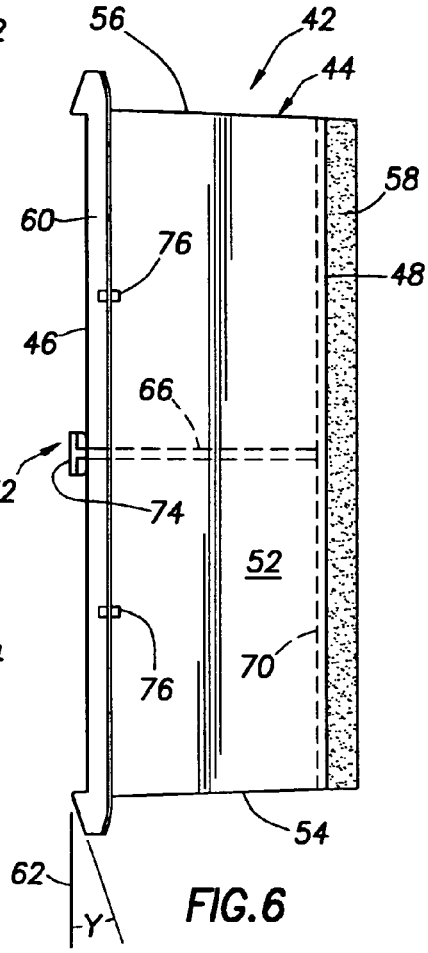
FIG. 6 is a right side elevational view of the insert as viewed in FIG. 5.
Figure 7:
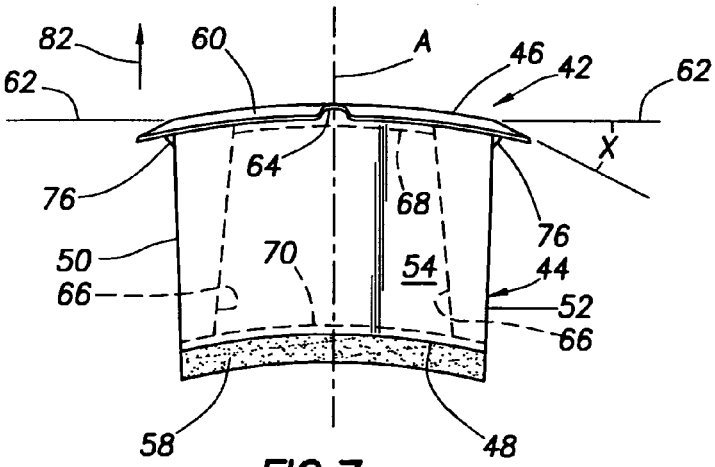
FIG. 7 is a bottom end elevational view of the insert as viewed in FIG. 5.
Figure 10:
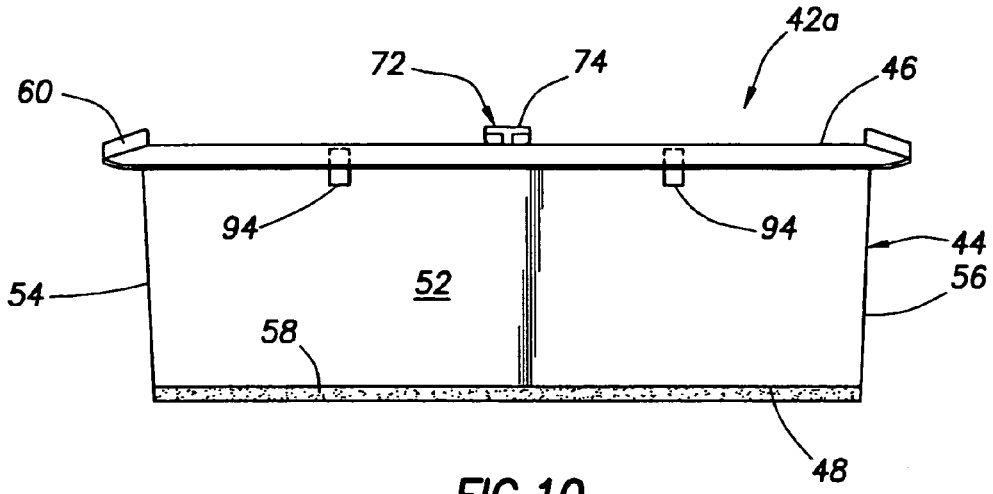
FIG. 10 is an enlarged scale side elevational view of a first alternate embodiment of the FIG. 4 insert.
Figure 11:
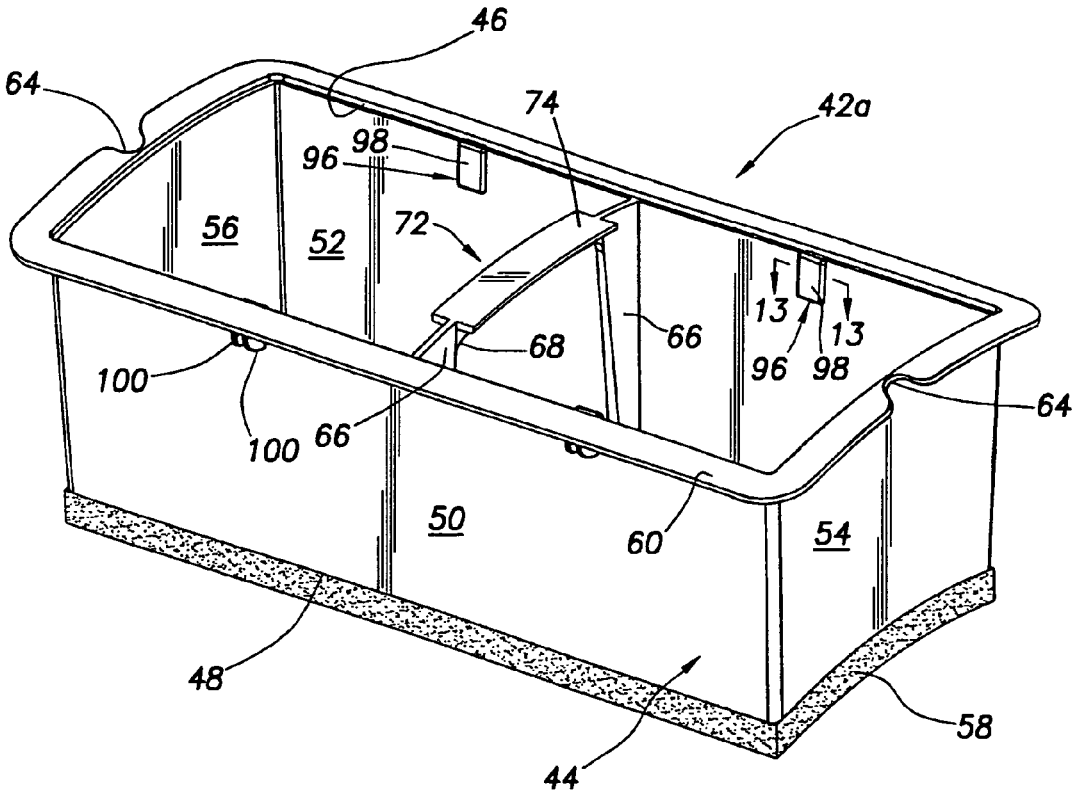
FIG. 11 is an enlarged scale perspective view of the FIG. 10 insert embodiment.
Figure 12:
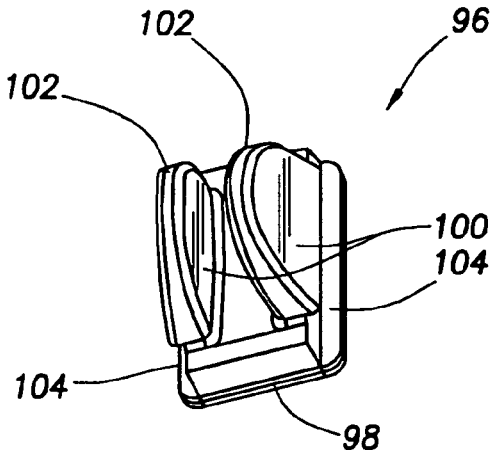
FIG. 12 is an enlarged scale perspective view of a separate locking/force exerting structure incorporated in the FIG. 10 insert embodiment.

As may be best seen in FIG. 7, the longer opposite sides of the lip 60, relative to a reference plane 62 transverse to the axis A, are laterally sloped axially inwardly (i.e., downwardly as viewed in FIG. 7) at an angle X. Representatively, but not by way of limitation, angle X is within the range of from about 25 degrees to about 27 degrees when the lip 60 is in its relaxed, undeflected state. As best illustrated in FIG. 6, the shorter opposite ends of the lip 60, relative to the reference plane 62, are laterally sloped axially inwardly at an angle Y. Representatively, but not by way of limitation, angle Y is within the range of from about 16.5 degrees to about 17.5 degrees. This slope differential between the opposite ends of the lip 60 and the opposite sides of the lip 60 facilitates the ability to use the insert 42 on jackets of differing diameters wherein the jacket opening 40 is the same size. For purposes later described herein, the opposite end portions of the lip 60 have small arcuate notches 64 formed therein.

Referring now to FIGS. 2–7, the foam dam body 44 is internally braced against undesirable deformation caused by the pressure of foam insulation 24, as it is being injected into the jacket/tank insulation space 22, by means of an internal bracing structure formed as an integral part of the body 44. This internal bracing structure includes an opposing pair of axially elongated transverse ribs 66 formed on central portions of the interior surfaces of the body side walls 50,52 and joined at their axially outer ends by a relatively thin web 68, and a peripheral flange 70 projecting transversely inwardly from the inner side edge of the body 44. The web 68 forms a portion of an installation handle structure 72 which also includes an elongated transverse plate 74 integrally formed with the web 68 on its outer side edge.

For purposes later described herein, on the exterior surface of each of the body side walls 50,52 a pair of generally triangular locking/force exerting projections 76 are formed. The projections 76 in each pair thereof are positioned just beneath the peripheral sealing lip 60 and are spaced apart from one another in a direction transverse to the body axis A. Each projection 76 has, as may be best seen in FIG. 3, an outer end surface 78 opposing the overlying lip 60, and a side surface 80 which inwardly slopes toward the open inner side 48 of the dam body 44.

The enclosure insert/foam dam 42 is operatively installed around the portions of the electrical components 30,32 by simply grasping the installation handle 72 and axially inwardly pushing the dam body 44 through the complementarily dimensioned jacket opening 40 until the inner side sealing strip 58 of the insert begins to become sealingly; compressed against an outer side surface portion of the tank 12 that circumscribes the outwardly projecting portions of the electrical components 30,32.

As the sealing strip 58 begins to be compressed during inward movement of the foam dam body 44, the outer sealing lip 60 engages an outer side surface portion of the jacket wall 20 circumscribing the jacket opening 40 and begins to be axially outwardly deflected by the jacket wall as indicated by the arrow 82 in FIG. 7. At the same time, the sloping side surfaces 80 of the force exerting projections 76 (see FIG. 3) deflect peripheral edge portions of the jacket wall 20 around the jacket opening 40 until the projections 76 are inwardly forced completely past the jacket opening, thereby further compressing the inner side sealing strip 58 and further resiliently deflecting the outer side sealing lip 60 axially outwardly.

Figure 3:
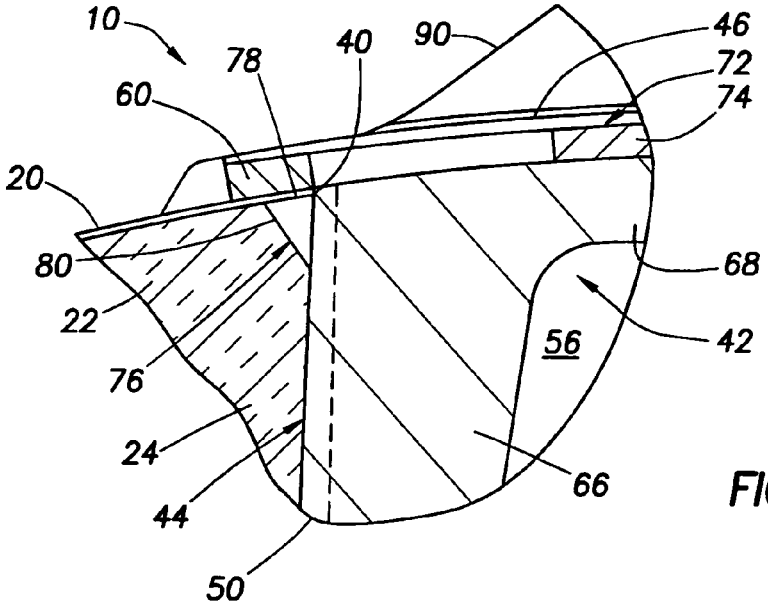
FIG. 3 is an enlarged scale detail view of the circled area "3" in FIG. 2.
Figure 4:
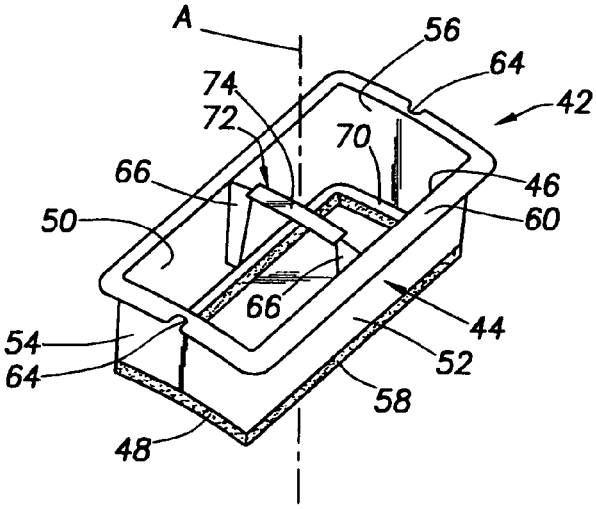
FIG. 4 is a perspective view of the insert removed from the water heater.

At this point, peripheral edge portions of the jacket wall 20 around the jacket opening 40 snap into place between the underside of the sealing lip 60 and the outer end surfaces 78 of the force exerting projections 76 as best illustrated in FIG. 3, thereby completing the "snap-in" insertion of the foam dam 42. With the foam dam 42 installed in this manner, the force exerting projections 76 forcibly bear against an inner side surface portion of the outer jacket wall 20 that circumscribes the jacket opening 40. This serves to lock the installed foam dam 42 in place within the insulation space 22 while at the same time maintaining the inner side sealing strip 58 in sealing compression against the outer side surface of the tank 12 and maintaining the outer side sealing lip 60 in its outwardly deflected forcible sealing engagement with the outer side surface of the jacket wall 20 around the periphery of the jacket opening 40.

Figure 8:
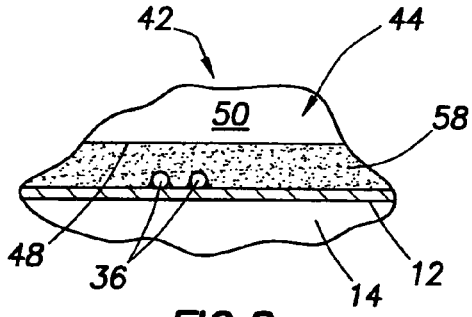
FIG. 8 is a cross-sectional view through the water heater taken generally along line 8—8 of FIG. 2.
Figure 9:
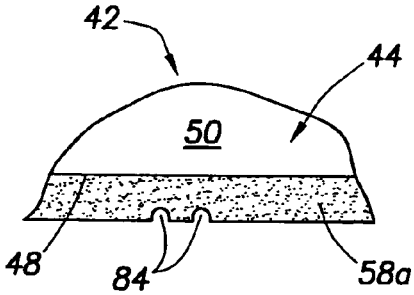
FIG. 9 is a view similar to that of FIG. 8 but illustrating an alternate embodiment of an inner side seal portion of the insert.

As previously mentioned herein, electrical wiring 36,38 is respectively run to the electrical components 30,32 (see FIGS. 1, 2 and 8). Conveniently, when the foam dam 42 is installed, an underside portion of the foam rubber inner sealing strip is simply deformed into sealing engagement with portions of the wiring as representatively illustrated in FIG. 8 for the wiring 36. An alternate embodiment 58*a* of the sealing strip 58 is illustrated in FIG. 9 and is representatively formed of a somewhat firmer sealing material such as a crushable polystyrene material. In this case, arcuate notches 84 may be formed in the underside of the sealing strip 58*a* to sealingly receive the electrical wires run to the electrical components 30,32.

With the one piece molded plastic foam dam 42 snapped into place as previously described herein, peripheral seals are automatically formed (1) on the outer side surface of the tank 12 around the outwardly projecting portions of the electrical components 30 and 32, and (2) around the jacket opening 40 on the outer side surface of the outer jacket wall 20. No other components are required to form these seals. Moreover, no other components are required to brace the installed foam dam 42 against pressure deflection, caused by the subsequent injection of pressurized liquid foam insulation into the insulation space 22, which would permit injected foam to enter the interior of the dam 42 and/or be forced outwardly through the jacket opening 40. Instead, such bracing is an integral part of the foam dam 42 and illustratively comprises the transverse lower internal flange 70 and the vertical interior ribs 66 which are joined by the slender handle structure 72.

Figure 5:
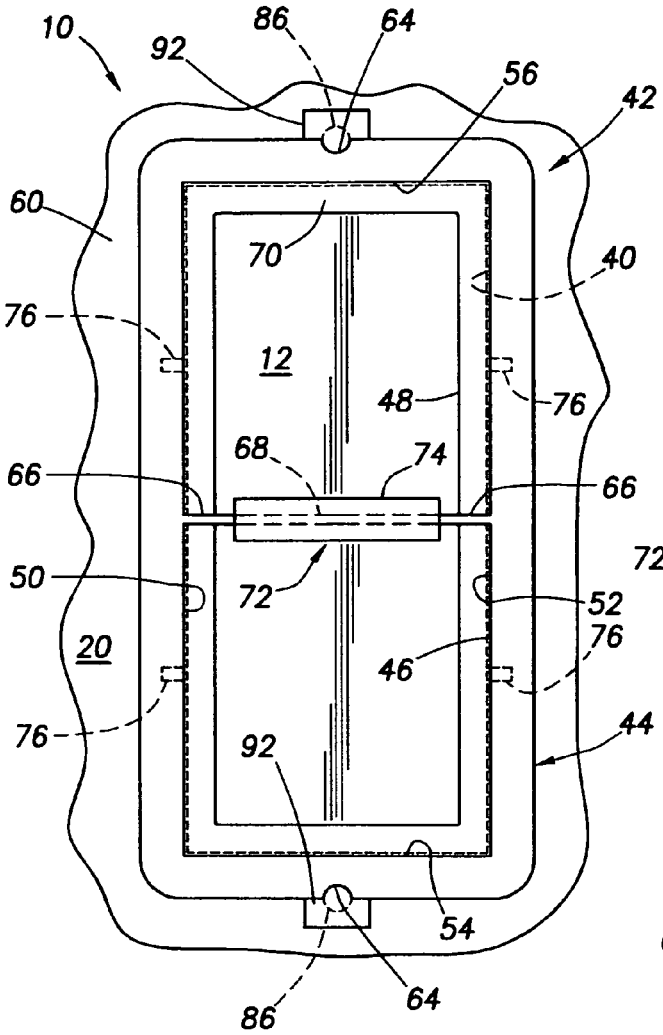
FIG. 5 is an enlarged scale outer side elevational view of the insert installed in the water heater, with an outer metal cover plate, and electrical components shielded by the insert having been removed for purposes of illustrative clarity.

As shown in FIG. 5 (in which the electrical components 30,32 have been omitted for purposes of illustrative clarity), a pair of circular connection openings 86 extend through the jacket wall 20 at the sealing lip end notches 64 of the installed insert/foam dam 42. These openings 86 receive screws 88 (see FIG. 1) used to removably attach an outer metal cover plate 90 (see FIGS. 1–3) over the open side of the installed foam dam 42. The installed cover plate 90 may engage a small outer side portion of the installed foam dam 42 but plays no role in creating a seal between the foam dam 42 and either the tank 12 or the jacket wall 20—these two seals are previously created and maintained by the design of the foam dam 42 in response to its installation as previously described herein.

Accordingly, it is not necessary to install the cover plate 90 prior to the foam injection process to shield the electrical components 30,32 from pressurized liquid foam or to prevent such liquid foam from being forced outwardly through the jacket opening 40. However, if desired, the cover plate 90 may be installed before the foam 24 is injected into the insulation space 22 in which case the screws 88 conveniently plug the jacket holes 86 to keep foam from being forced outwardly therethrough. In the event that the foaming-in process is carried out prior to the installation of the cover plate 90, small pieces of tape 92 (see FIG. 5), or other suitable blocking structures, may be placed over the connection openings 86 prior to the foaming process. In the subsequent installation of the cover plate 90, the screws 88 may simply be extended through the tape 86 into the connection openings 88.

It should be noted that if the foam injection process is carried out without installing the outer metal cover plate 90, essentially the entire open outer side 46 of the installed foam dam 42 remains uncovered during the foaming process. It is not necessary to cap off the open outer foam dam side for any purpose during the foaming-in process. This maintains ready manual access to the electrical components shielded by the foam dam 42 and additionally provides for ready visual verification that injected foam is not entering the interior of the installed foam dam 42.

A first alternate embodiment 42*a* of the previously described foam dam 42, and associated portions of the embodiment 42*a*, are illustrated in FIGS. 10–14. Foam dam 42*a* is identical in construction to the previously described foam dam 42 with the exception that in the foam dam 42*a* the previously described integral locking and force exerting projection structures 76 on the foam dam 42 are replaced with rectangular openings 94, formed in the foam dam body side walls 50 and 52, which receive separate snap-in locking and force exerting structures 96.

Each of the snap-in locking and force exerting structures 96 (see FIGS. 12 and 13) is representatively of a molded plastic construction and has a small rectangular base plate portion 98 from one side of which a spaced apart pair of locking/force exerting tabs 100 outwardly project. The tabs 100 in each pair thereof slope away from their associated base plate 98 and toward one another (see FIG. 13), and have arcuate outer side edges 102. A pair of oppositely facing locking notches 104 are formed in each locking and force exerting structure 96 adjacent the inner sides of its outwardly projecting tabs 100.

Figure 13:
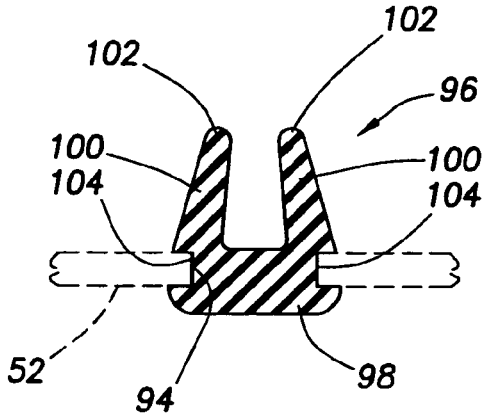
FIG. 13 is an enlarged scale cross-sectional view through the FIG. 10 insert embodiment taken generally along line 13—13 of FIG. 11.

To operatively position the insert/foam dam 42*a* within the jacket opening 40 (see FIG. 14), the installer grasps the handle portion 72 and pushes the foam dam body 44 inwardly through the jacket opening 40 until the inner side sealing strip 58 is compressed against the tank 12, the outer sealing lip 60 is outwardly deflected and brought into sealing engagement with the outer side of the jacket wall 20, and the rectangular body openings 94 are disposed inwardly of the jacket wall 20. While holding the inserted foam dam 42*a* in this orientation the installer simply presses the tab pairs 102 of the four locking/force exerting structures 96 outwardly through the side wall openings 94 in a manner causing the tabs 102 in each pair thereof to cam toward one another and a peripheral portion of each side wall opening 94 to snap into to the locking notch portions 104 of the inserted locking/force exerting structure 96 as indicated in FIG. 13.

Figure 14:
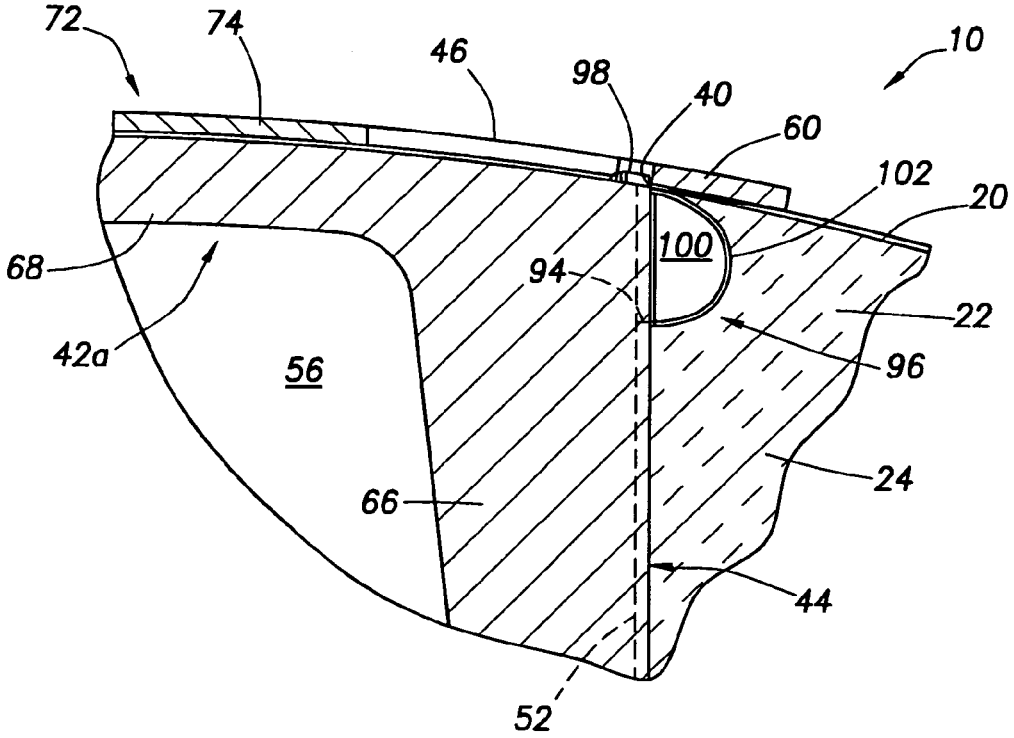
FIG. 14 is a cross-sectional view through the water heater similar to that in FIG. 3 but with the FIG. 10 electrical enclosure insert operatively installed in the water heater.
Figure 15:
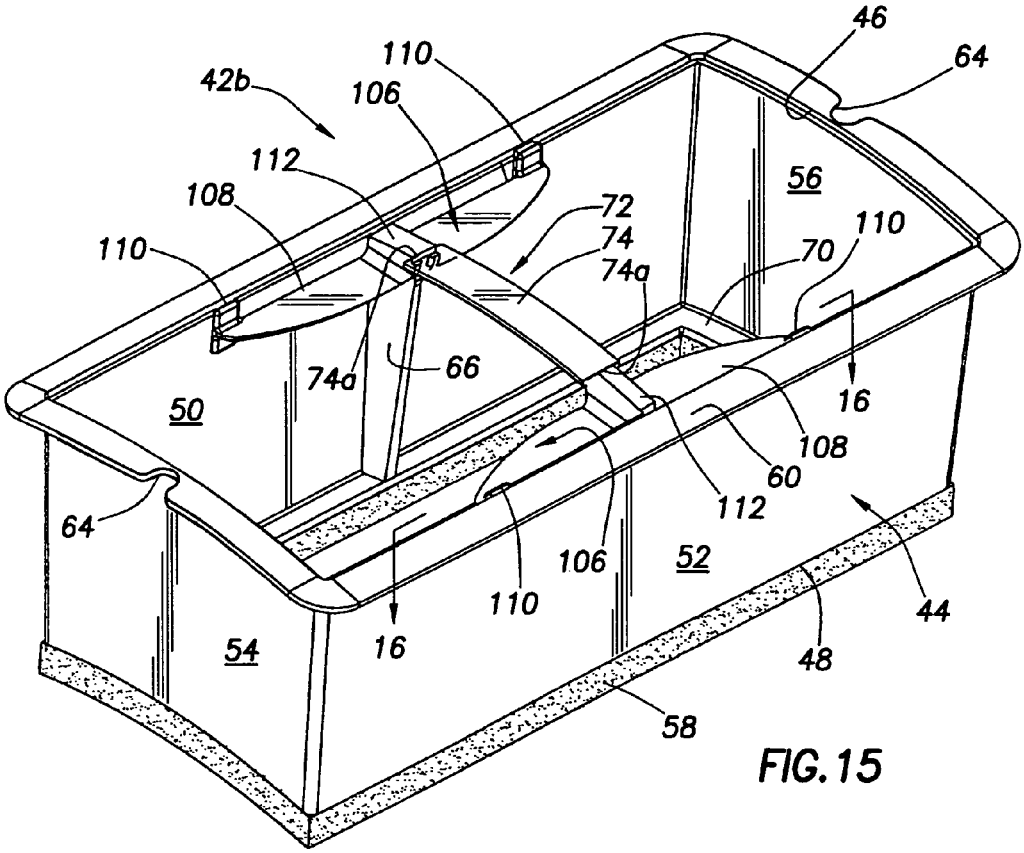
FIG. 15 is a perspective view of a second alternate embodiment of the FIG. 4 insert.

This causes the tab pairs 100 to underlie portions of the jacket wall 20 spaced apart around the periphery of the jacket opening 40 as best illustrated in FIG. 14. The installer then releases the inserted foam dam 42*a*. The outwardly projecting tabs 100 then function to lock the inserted foam dam 42*a* in place within the insulation space 22, maintain the outer sealing lip 60 in an outwardly deflected sealing relationship with the outer side of the jacket wall 20 around the periphery of the jacket opening 40, and maintain the inner side sealing strip 48 in a compressed sealing relationship with the tank 12 around the outwardly projecting portions of the electrical components 30,32. Assuming that all other jacket openings are appropriately sealed off, and other structures within the insulation space 22 are dammed off if necessary, the foam injection process may then be initiated.

It should be noted that by using the foam dam 42*a* instead of the foam dam 42, the outward projection distance of each of the tabs 100 may advantageously be considerably greater than the corresponding outward projection distance of each of the previously described side wall projections 76 (see FIG. 3) since the outwardly projecting tabs 100 do not have to be forced inwardly through the jacket opening 40 in a manner deflecting peripheral portions of the jacket wall opening 40. Once installed, the foam dam 42*a* functions in essentially the same manner, and provides essentially the same advantages, as the previously described insert/foam dam 42.

A second alternate embodiment 42*b* of the previously described foam dam 42, and associated portions of the embodiment 42*b*, are illustrated in FIGS. 15–18. Foam dam 42*b* is identical to the previously described foam dam 42*a* with the exception that it is provided with two modified separate snap-in locking/force exerting structures 106 used in place of the previously described locking force exerting structures 96 used in conjunction with the foam dam 42*a*.

Each locking/force exerting structure 106 has an elongated plate-shaped body portion 108 with transverse rectangular base portions 110 on side edge portions of its opposite ends. Each of the base portions 110 has a spaced pair of generally triangular tabs 111 projecting outwardly from a side surface thereof. A raised, longitudinally central portion 112 of each body 108 has a bottom side notch 114 formed therein, and a downwardly inset pair of upwardly facing abutment surfaces 116.

The foam dam 42*b* is operatively installed on the water heater 10 by pushing the foam dam body 44 inwardly through the jacket opening 40 until the inner side sealing strip 58 is compressed against the tank 12, the outer side sealing lip 60 is outwardly deflected and brought into forcible sealing contact with the outer side surface of the outer jacket wall 20, and the body side wall openings 94 are disposed inwardly of the outer jacket wall 20. While holding the inserted body 44 in this position, the installer simply snaps one of the locking/force exerting structures 106 onto each of the body side walls 50 and 52.

Figure 16:
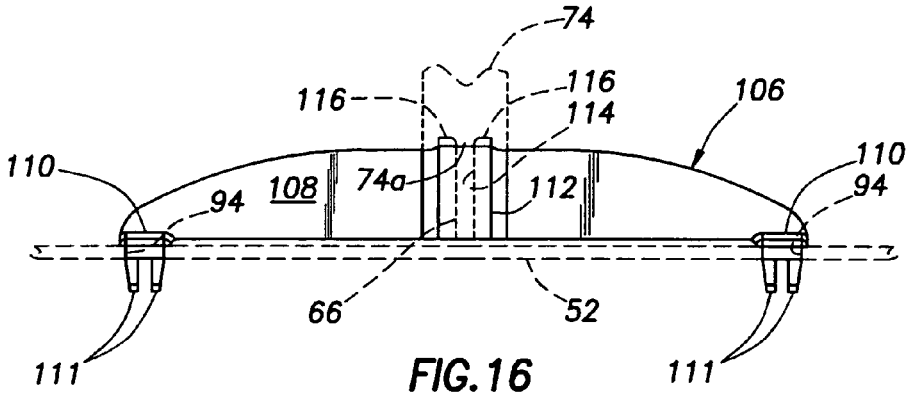
FIG. 16 is a top side view, taken generally along line 16—16 of FIG. 15, of a locking/force exerting member incorporated in the FIG. 15 insert embodiment and illustrating in phantom the connection of the locking/force exerting member to handle and side wall portions of the FIG. 15 insert embodiment.
Figure 18:
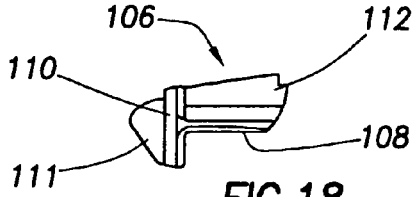
FIG. 18 is a partial left end elevational view of the locking/force exerting member as viewed in FIG. 17.

For each of the locking/force exerting structures 106 this entails inserting each pair of tabs 111 outwardly through one of the two openings 96 in the particular body side wall, and then forcing the locking/force exerting structure body 108 downwardly until an upper end portion of the underlying vertical interior rib 66 enters the bottom side notch 114 and the abutments 116 snap into place under an adjacent end 74*a* of the elongated handle plate 74 as may be best seen in FIG. 16. The other locking/force exerting structure 106 is then installed in the same manner on the other side of the inserted foam dam 42*b*.

Figure 17:
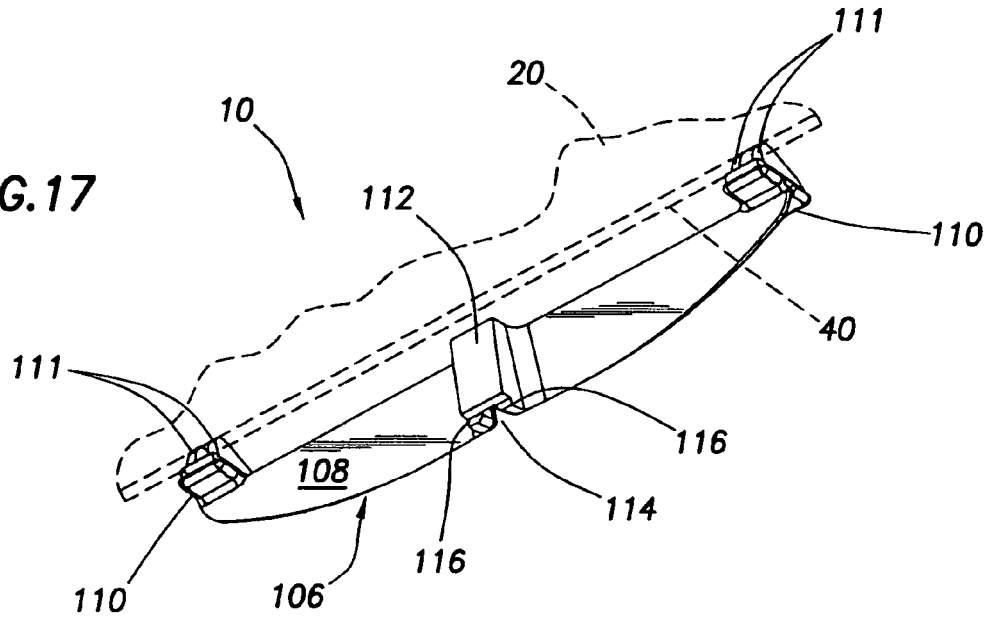
FIG. 17 is a perspective view of the FIG. 16 locking/force exerting member illustrating in phantom its engagement with the outer jacket wall of the water heater when the FIG. 15 insert is operatively installed therein.

The installer then releases the foam dam 42*b* so that, as indicated in FIG. 17, the upper sides of the tabs 111 engage the underside of the outer jacket wall 20 to thereby lock the inserted foam dam 42*b* in place and maintain its sealing contact with the tank and the outer side surface of the outer jacket wall 20. Assuming that all other jacket openings are appropriately sealed off, and other structures within the insulation space 22 are dammed off if necessary, the foam injection process may then be initiated. Once installed, the foam dam 42*b* functions in essentially the same manner, and provides essentially the same advantages, as the previously described insert/foam dam 42.

Figure 19:
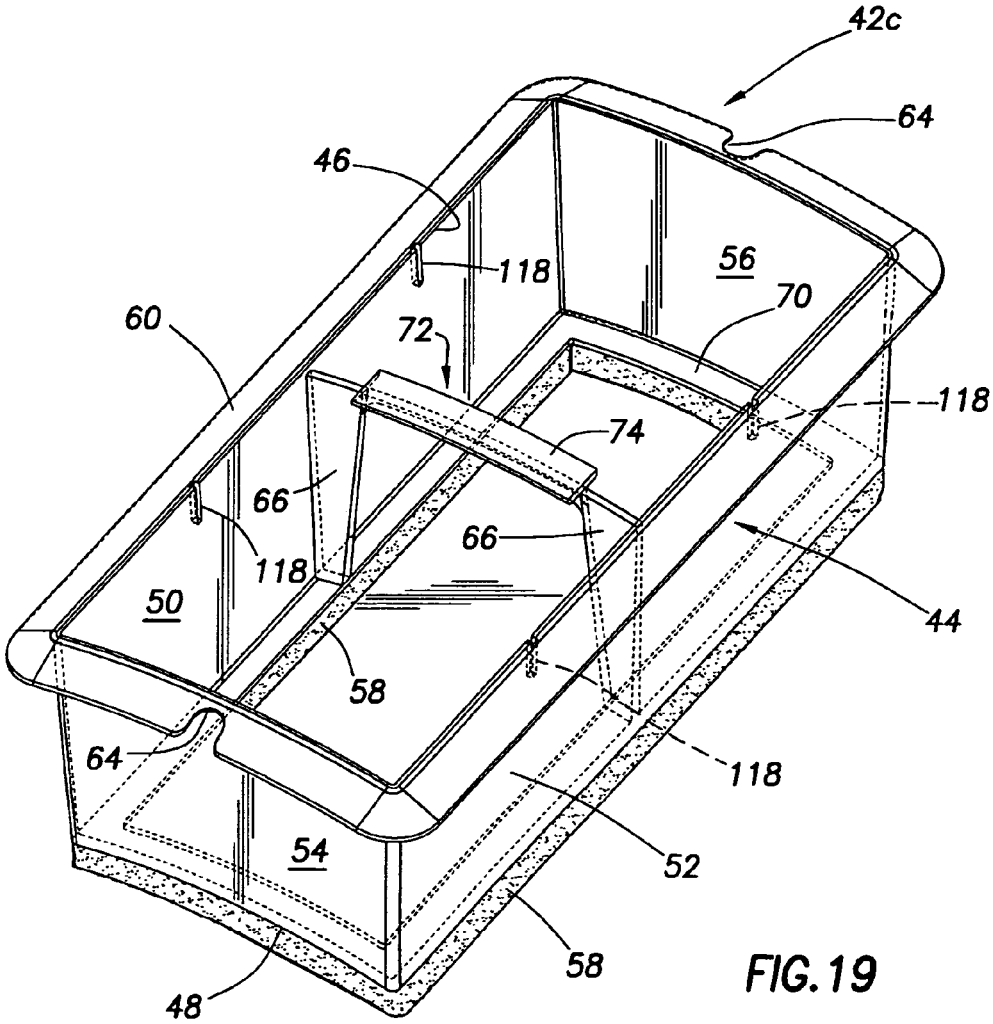
FIG. 19 is a perspective view of a third alternate embodiment of the FIG. 4 insert with locking/force exerting members removed therefrom for purposes of illustrative clarity.
Figure 20:
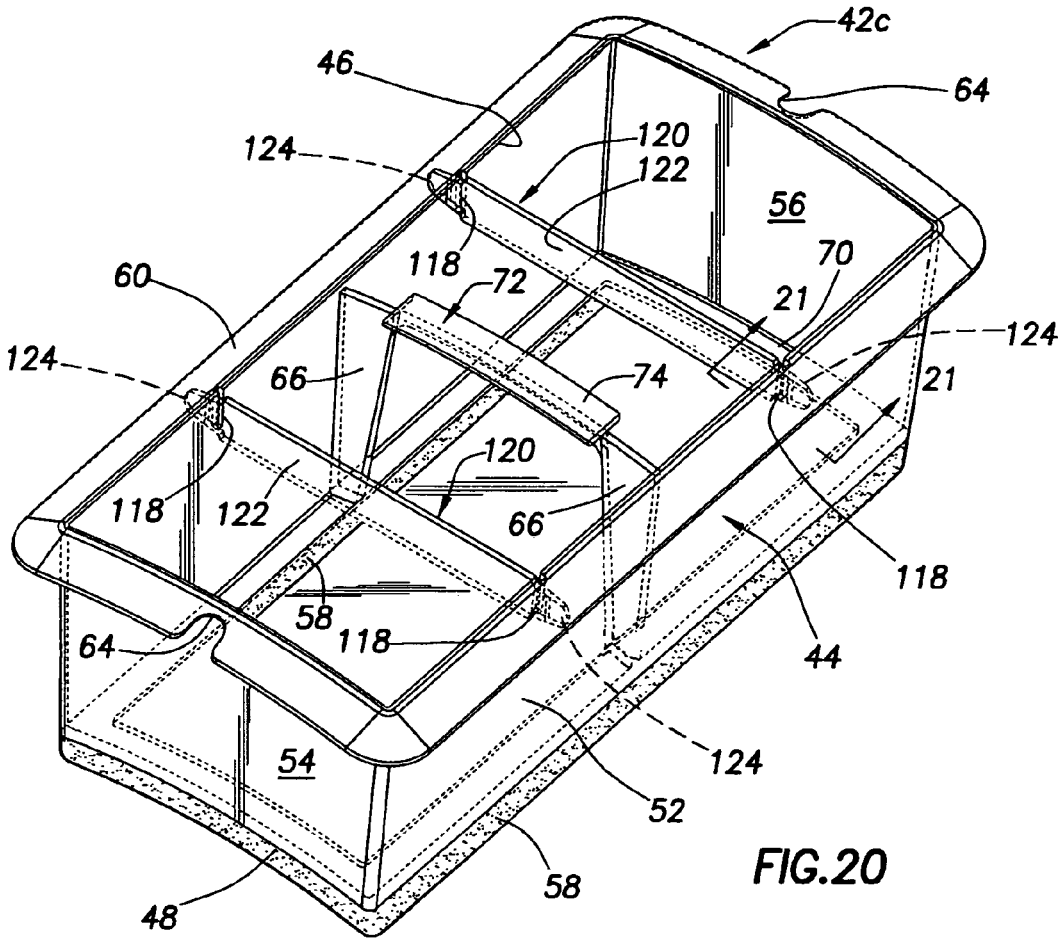
FIG. 20 is a perspective view of the FIG. 19 insert with the locking/force exerting members operatively installed therein.

A third alternate embodiment 42*c* of the previously described foam dam 42, and associated portions of the embodiment 42*c*, are illustrated in FIGS. 19 and 20. Foam dam 42*c* is identical to the previously described foam dam 42*a* with the exceptions that (1) the rectangular side wall openings 94 used in the foam dam 42*a* are replaced in the foam dam 42*c* with narrow, vertically oriented slits 118 (see FIG. 19), and (2) the foam dam 42*c* is provided with two modified separate snap-in locking/force exerting structures 120 (see FIG. 20) used in place of the previously described locking force exerting structures 96 incorporated in the foam dam 42*a*.

Figure 21:
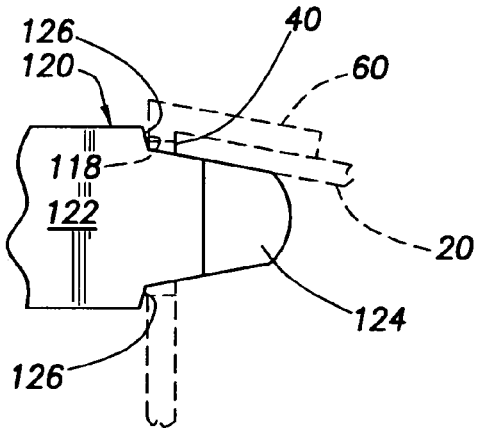
FIG. 21 is an enlarged scale, partially phantomed cross-sectional view through a portion of the FIG. 20 insert, taken along line 21—21 of FIG. 20, illustrating the engagement of one the locking/force exerting members with the outer jacket wall of the water heater.

With reference now to FIGS. 20 and 21, each of the two locking/force exerting members 120 is of a molded plastic construction and has an elongated, strip-like body 122 with narrower tapered end portions 124 that define a pair of abutment ledges 126 at their junctures at the ends of the body 122 with which they are associated. The tapered end portions 124 are insertable outwardly through the side wall slits 118, but the ledges 126 preclude the rest of the either body 122 from longitudinally passing outwardly through any of the slits 118.

To operatively install the foam dam 42*c* the installer presses the foam dam body 44 inwardly through the jacket wall opening 40 (as previously described for the foam dam embodiments 42*a* and 42*b*) until the side wall slits 118 are disposed inwardly of the periphery of the jacket wall opening 40. While still holding the foam dam body 44 in this orientation, the installer longitudinally bows one of the strip-like locking/force exerting member bodies 122, places their end portions 124 in opposing pairs of the side wall slits 118, and then releases the bowed body 122 to thereby permit it to straighten and drive its end portions 124 outwardly through their associated side wall slits 118. As previously mentioned, the body end ledges 126 form abutments which prevent the balance of the now installed body strip 122 from passing outwardly through either of its associated side wall slits 118.

With the installer still pressing the foam dam body 44 inwardly through the jacket opening 40, the other locking/force exerting member 120 is installed on the foam dam body 44 in the same manner. The installer then releases the foam dam body 44. This causes upper edge portions of the outwardly projecting end portions 124 of the installed locking/force exerting members 120 to upwardly engage the underside of the jacket wall 20 (see FIG. 21) in a manner holding the outer side sealing lip 60 in it outwardly deflected, sealing engagement with the outer side surface of the jacket wall 20 and at the same time holding the lower side sealing strip 58 in a compressed, sealing engagement with the outer side surface of the tank 12 around the outwardly projecting portions of the electrical components 30,32. Once installed, the foam dam 42*c* functions in essentially the same manner, and provides essentially the same advantages, as the previously described insert/foam dam 42.

Figure 22:
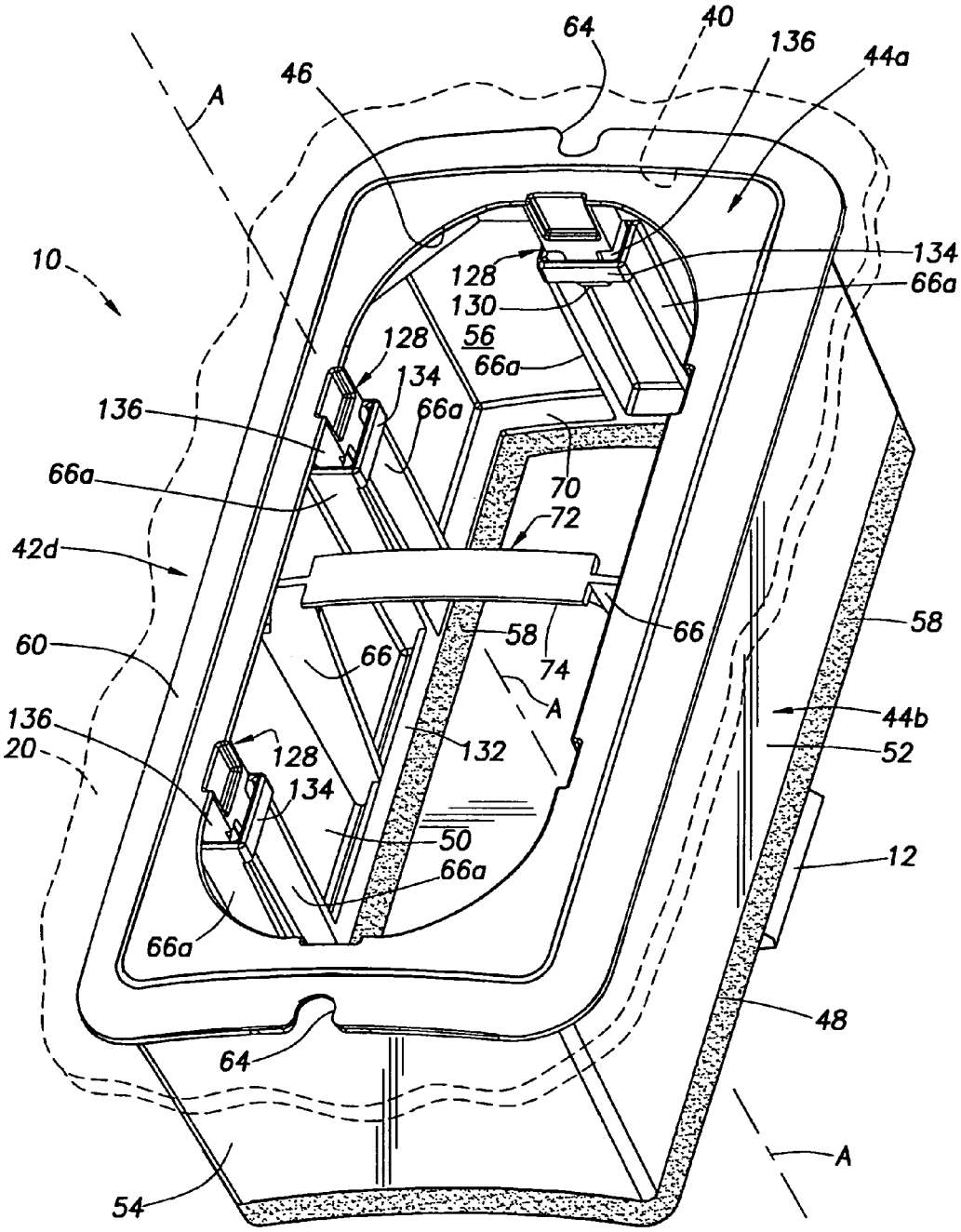
FIG. 22 is a perspective view of a two piece, snap-together fourth embodiment of the FIG. 4 insert operatively installed in the water heater.
Figure 22A:
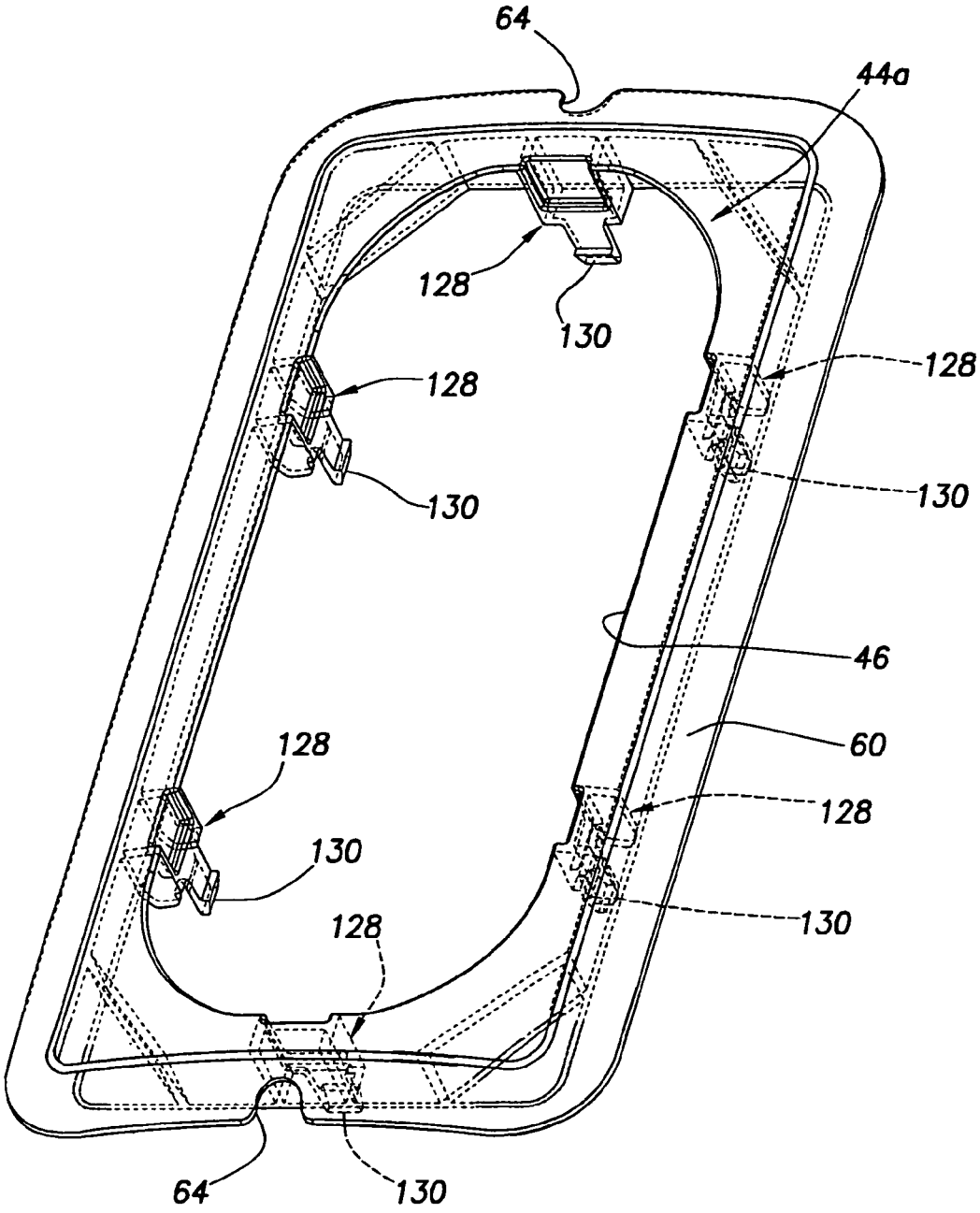
FIGS. 22A and 22*b*, respectively, are perspective views of outer and inner snap-together portions of the FIG. 22 insert embodiment.
Figure 22B:
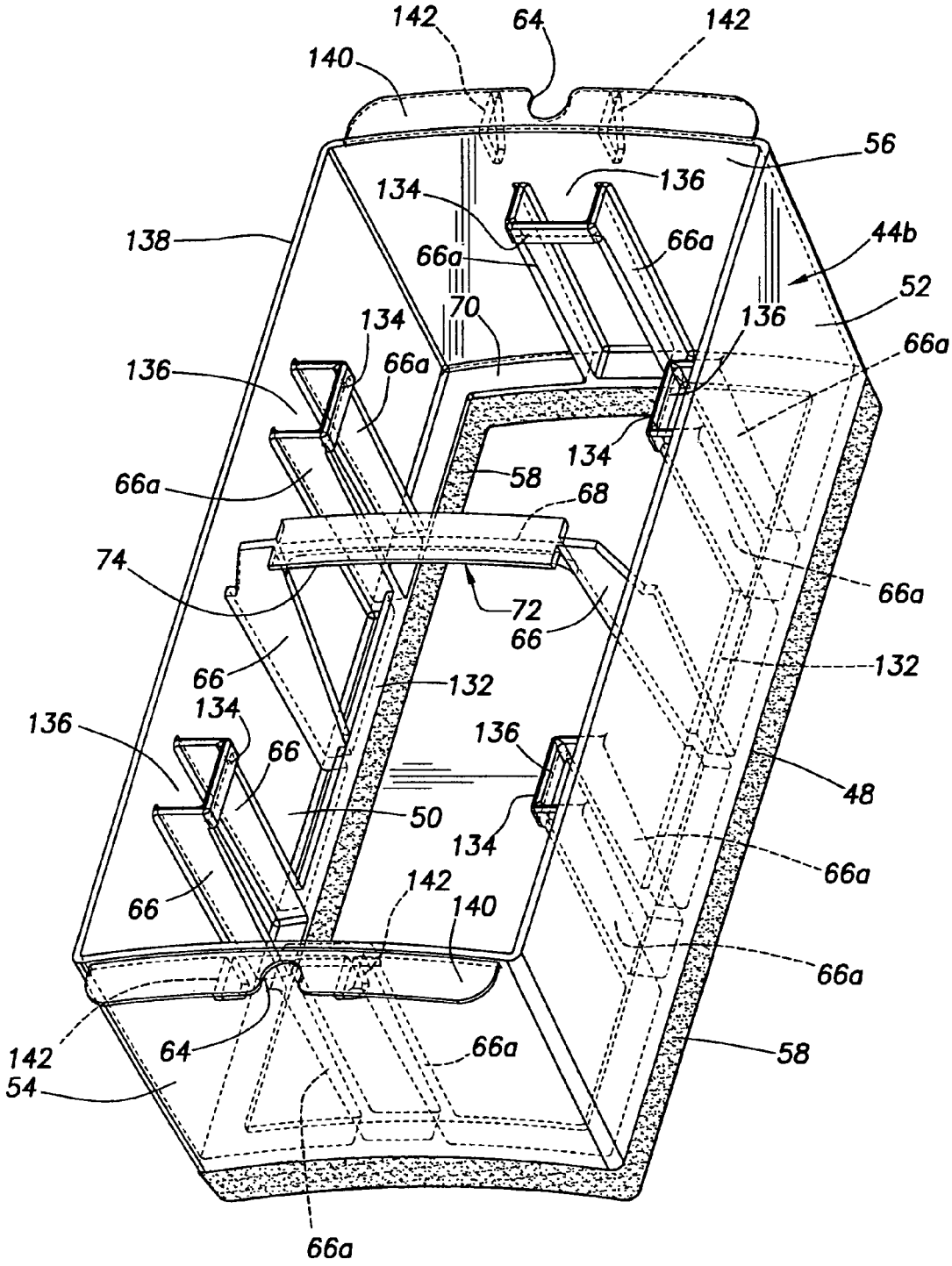

A fourth alternate embodiment 42*d* of the previously described foam dam 42 is perspectively illustrated in FIGS. 22–22B. In the foam dam embodiment 42*d*, the rectangular molded plastic body 44 which circumscribes the axis A is of a two piece, snap-together construction in which the body 44 comprises an axially outer portion 44*a* (see FIG. 22A) having the open outer side 46 and the axially inwardly sloped peripheral sealing lip 60 formed thereon, and an axially inner portion 44*b* (see FIG. 22B) to the open inner side 48 of which the resilient sealing strip 58 is secured. Projecting axially inwardly from the periphery of the open outer side 46 (see FIG. 22A) of the outer portion 44*a* are a circumferentially spaced series of resilient locking tabs 128 having tapered, laterally enlarged axially inner end portions 130.

The interior of the axially inner body portion 44*b* is braced with a spaced plurality of vertically elongated ribs 66, and laterally upturned bracing flanges 132 formed on the internal flange 70 along central portions of the body side walls 50 and 52. Ribs 66 include adjacent rib pairs 66*a*,66*a* between axially outer end portions of which joining bars 134 extend to form therewith locking recesses 136. As best illustrated in FIG. 22*b*, the open upper side of the axially inner body portion 44*b* has a rectangular edge periphery 138. Elongated force exerting plates 140, in which the arcuate end notches 64 are formed, project outwardly from the end walls 54,46 of the inner body portion 44*b*. Plates 140 are axially inset from the edge periphery 138, and are braced to the end walls 54,56 with suitable underside gussets 142.

The two piece snap-together foam dam 42*d* is operatively installed on the water heater 10 (as shown in simplified form in FIG. 22) by first axially inserting the inner body portion 44*b* inwardly through the jacket opening 40 in a manner such that the inner side sealing strip 58 is compressed against the tank 12, with the rectangular periphery 138 of the inner body portion 44*b* complementarily received in and upwardly extending through the jacket opening 40, and the force exerting projections 140 underlying and forcibly engaging inner side portions of the jacket wall 20. This initial insertion of the inner body portion 44*b* through the jacket wall opening 40, which locks the body portion 44*b* in place within the insulation space 22 and maintains the sealing strip 58 in compression against the tank 12, is facilitated using the narrow handle structure 72 and tilting the body portion 44*b* endwise as it is initially inserted through the jacket opening 40 until both projections 140 underlie the jacket wall 20, and then allowing the body portion peripheral edge portion 138 to pop-up through the complementarily sized jacket opening 40.

Next, the outer body portion 44*a* is snapped into place onto the now installed inner body portion 44*b* by simply telescoping an inner side portion of the outer body portion 44*a* into the inner body portion 44*b* and forcing the locking tabs 128 on the outer body portion 44*a* downwardly into associated ones of the locking recesses 136 until the tapered tab portions 130 snap into place beneath the joining bars 134. This locks the outer body portion 44*a* onto the inner body portion 44*b* in a manner axially outwardly deforming the sealing lip 60 into sealing engagement with an outer side surface portion of the jacket wall 20 around its opening 40 and protectively isolating electrical or other components surrounded by the installed foam dam 42*d* from foam injected into the water heater insulation space 22 as previously described herein. As can be seen, in this embodiment 42*d* of the foam dam the projections 76*a* and the interfitting tabs 128 and locking recesses 136 collectively define locking and force exerting structures that lock the installed foam dam 42*d* in place on the water heater 10 and maintain the sealing elements 58 and 60, respectively, in operative sealing engagement with the tank 12 and jacket 20.

Figure 23:
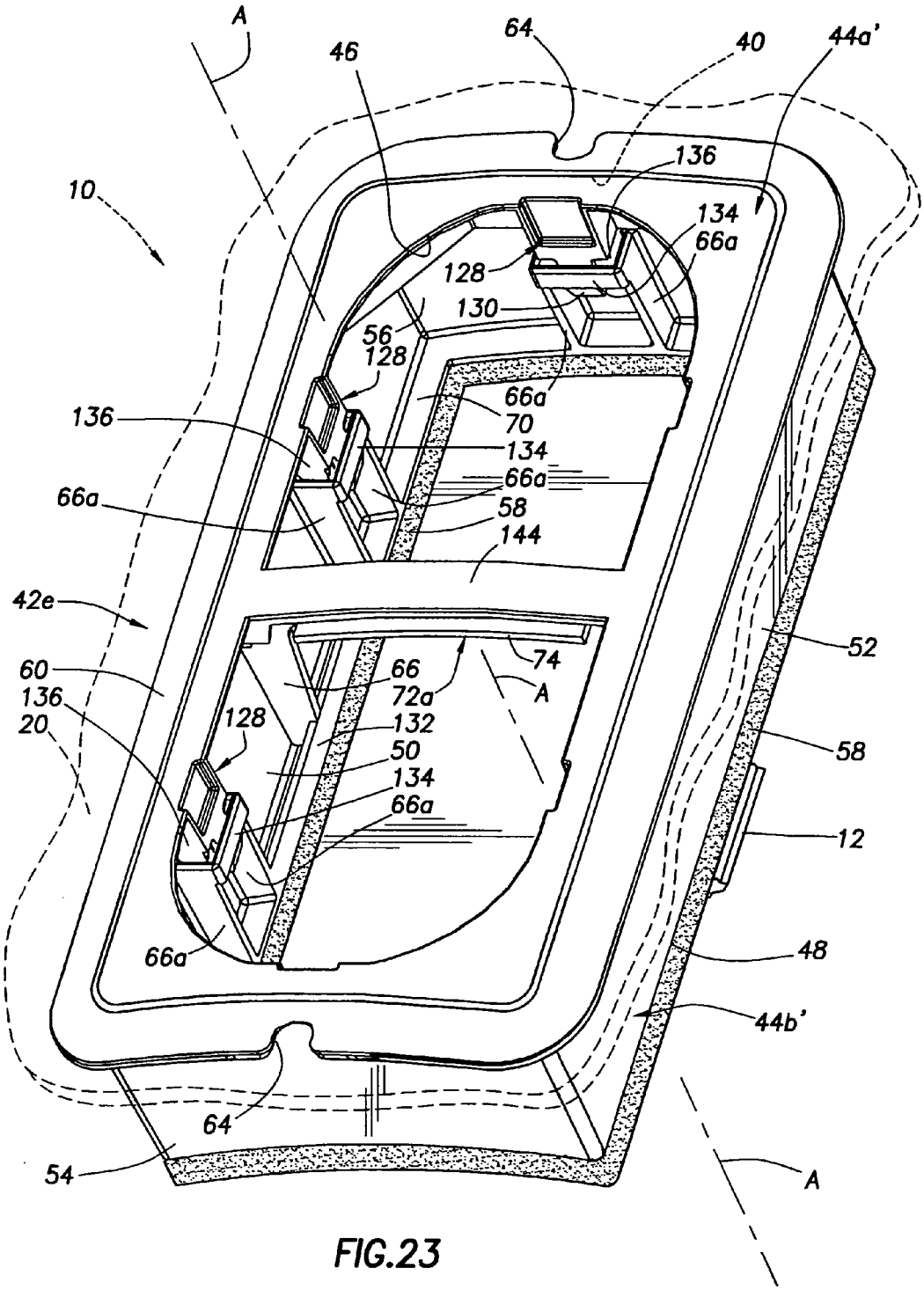
FIG. 23 is a perspective view of a two piece, snap-together firth alternate embodiment of the FIG. 4 insert operatively installed in the water heater.
Figure 23A:
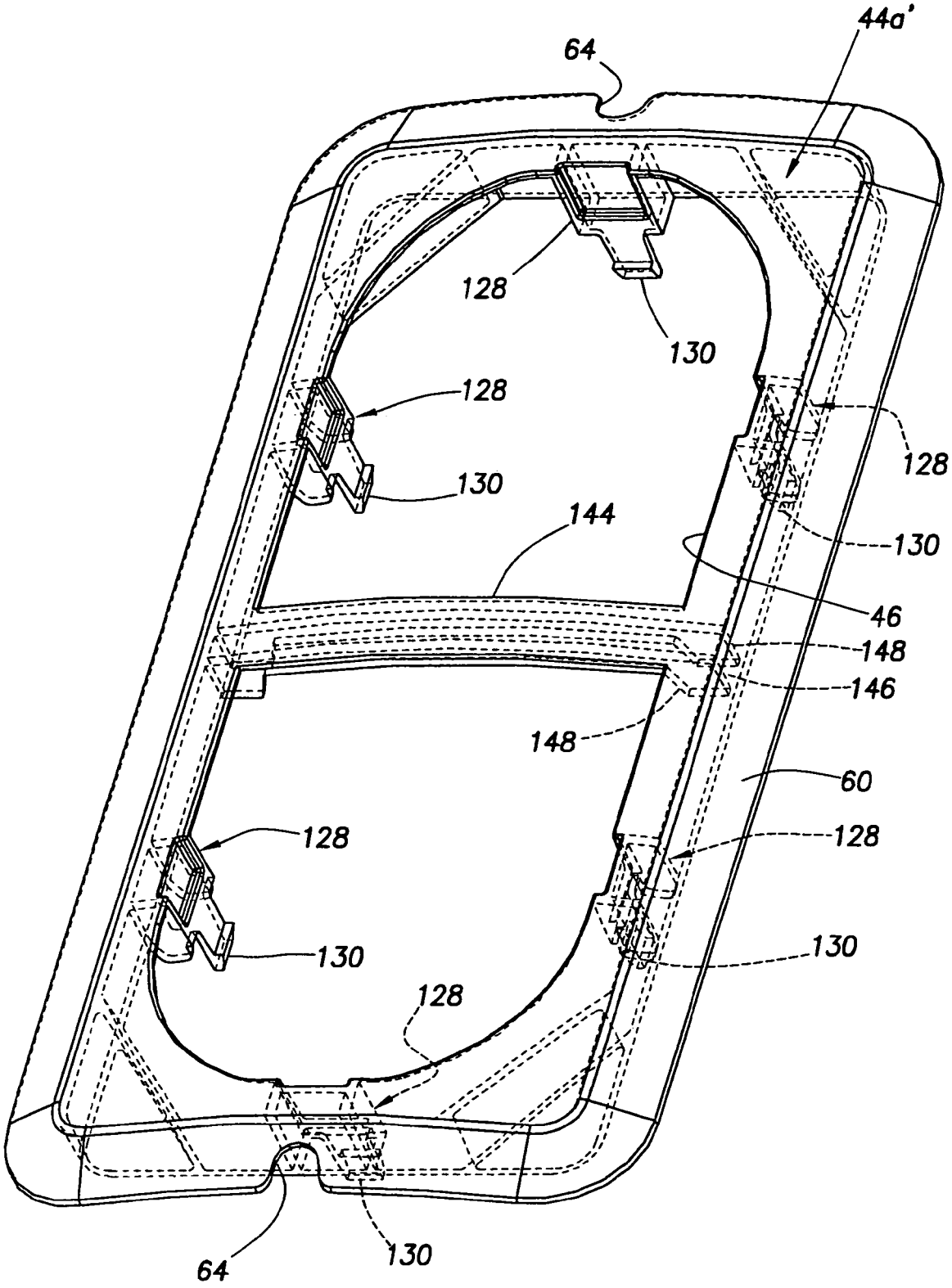
FIGS. 23A and 23B, respectively, are perspective views of outer and inner snap-together portions of the FIG. 23 insert embodiment.
Figure 23B:
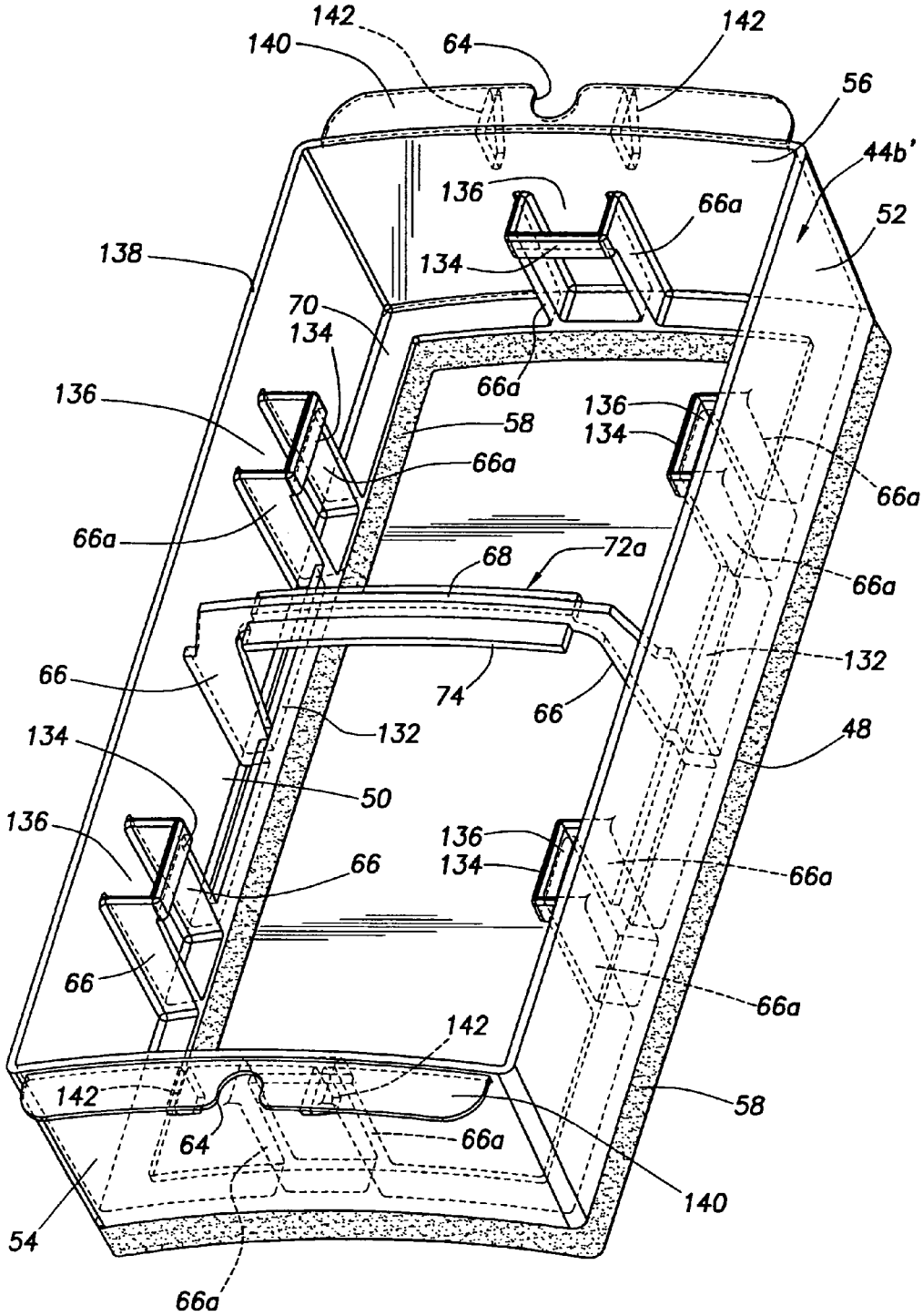

A fifth alternate embodiment 42*e* of the previously described foam dam 42 is perspectively illustrated in FIGS. 23–23B. Foam dam embodiment 42*e* is substantially identical in construction, installation and operation to the previously described two piece snap-together foam dam embodiment 42*d* with the following noted exceptions.

In the foam dam embodiment 42*e* illustrated in FIGS. 23–23B, the axially outer body portion 44*a'* has an elongated central reinforcing plate 144 longitudinally extending across the open outer side 46 of the outer body portion 44*a'* between the longer side portions of the lip 60. Depending from the plate 144, and defining a slot 146 therebetween, are a pair of flanges 148 (see FIG. 23A). the inner body portion 44*b'* has a modified handle structure 72*a* (see FIG. 23B) in which the previously described handle plate 74 is positioned on the underside of the rib joining web 68.

The modified two piece snap-together foam dam 42*e* is installed on the water heater 10 in the same manner as that previously described for the foam dam embodiment 42*d*. However, when the outer body portion 44*a'* is snapped onto the previously inserted inner body portion 44*b'*, the joining web 68 of the modified handle structure 72*a* (see FIG. 23B) is complementarily and interlockingly received in the overlying slot 146 (see FIG. 23*a*) beneath the reinforcing plate 144 to thereby further brace the assembled foam dam 42*e* against undesirable deflections caused by foam insulation injection pressure forces exerted thereon.

While the foregoing representative foam dam embodiments have been illustrated and described as being used in conjunction with an electric water heater, it will readily be appreciated by those of skill in this particular art that they could be also advantageously utilized with fuel-fired water heaters as well as with various other types of foam insulated liquid heating apparatus. Additionally, while the foam dam embodiments have been illustrated and described as being utilized in the shielding of electrical components, they could also be used in the shielding of a variety of other types of structures (such as pipe couplings or other mechanical structures) projecting outwardly from the tank 12 or other type of fluid containing vessel into the insulation space 22. Further, while the shapes of the illustrated foam dam embodiments are representatively rectangular they could, of course, have a variety of other shapes including, but not limited to, round, square and other polygonal shapes if desired or necessary.

The foregoing detailed description is to be clearly understood as being given by way of illustration and example only, the spirit and scope of the present invention being limited solely by the appended claims.

What is claimed is:

1. A foam dam comprising:

a hollow body portion having open outer and inner sides spaced apart along an axis circumscribed by said body portion, said open outer side having a laterally outwardly projecting, resiliently deflectable sealing lip sloped laterally outwardly and axially inwardly toward said open inner side of said body portion; and a locking/force exerting structure carried by said hollow body portion, at least a portion of said locking/force exerting structure projecting laterally outwardly from said hollow body portion and being disposed axially inwardly of said sealing lip in a facing relationship therewith.

2. The foam dam of claim 1 further comprising a resilient sealing structure secured to and extending around the periphery of said open inner side of said body portion.

3. The foam dam of claim 1 wherein said locking/force exerting structure includes a plurality off external projections spaced apart around said axis.

4. The foam dam of claim 3 wherein said hollow body portion is of a molded plastic construction and said plurality of external projections are formed integrally with said body portion.

5. The foam dam of claim 3 wherein:

said hollow body portion has a wall portion circumscribing said axis and having a plurality of openings therein which are spaced apart around said axis, and said locking/force exerting structure includes a plurality of locking/force exerting members snap-fittable to a portion of said foam dam in a manner causing portions off said locking/force exerting members to extend outwardly through said plurality of openings to define said plurality of external projections.

6. The foam dam of claim 5 wherein said locking/force exerting members are individually snap-fittable to said wall portion at said openings therein.

7. The foam dam of claim 5 wherein each of said locking/force exerting members is an elongated resilient strip member having outer end portions receivable in an opposed pair of said wall openings to define said plurality of external projections.

8. The foam dam of claim 5 wherein:

said foam dam further comprises a handle structure extending across said open outer side, and each of said locking/force exerting members has an elongated body having a longitudinally central portion snap-fittable to said handle structure and having opposite end portions extendable outwardly through said wall openings to define said plurality of external projections.

9. The foam dam of claim 1 further comprising bracing structure disposed on an interior portion of said body portion.

10. The foam dam of claim 9 wherein said bracing structure includes an inwardly projecting flange extending around the periphery of said open inner side of said body portion.

11. The foam dam of claim 9 wherein said bracing structure includes a spaced plurality of axially elongated ribs.

12. The foam dam of claim 11 wherein said ribs include a facing pair of ribs disposed on opposite interior sides of said body portion.

13. The foam dam of claim 12 further comprising a handle structure having outer end portions secured to axially outer end portions of said facing pair of ribs.

14. The foam dam of claim 2 wherein said resilient sealing structure has indentations formed therein for sealingly receiving electrical wires.

15. The foam dam of claim 1 wherein said sealing lip has a rectangular shape with first and second pairs of opposing side portions, the slopes of one of said pairs of opposing side portions being greater than the sloped of the other pair of opposing side portions.

16. The foam dam of claim 1 wherein said body portion has a generally rectangular shape.

17. The foam dam of claim 1 wherein said open inner side has a concave curvature.

18. The foam dam of claim 1 wherein said hollow body portion is of a one piece molded plastic construction.

19. The foam dam of claim 1 wherein said hollow body portion has separate axially outer and inner sections which are snap-fittingly engageable with one another.

20. The foam dam of claim 18 wherein said sealing lip is carried by said outer section.

21. The foam dam of claim 20 wherein said locking/force exerting structure includes an interior portion of said inner section interlockable with a corresponding portion of said outer section.

22. The foam dam of claim 20 wherein said locking/force exerting structure includes an exterior portion of said inner section projecting outwardly therefrom transversely to said axis.

23. The foam dam of claim 1 wherein said axially inner section has a bracing structure disposed on an interior portion thereof.

24. The foam dam of claim 23 wherein said bracing structure includes an inwardly projecting flange extending around the periphery of the open inner side of said inner section.

25. The foam dam of claim 24 wherein said bracing structure further includes a reinforcing rib portion laterally projecting axially from said flange.

26. The foam dam of claim 23 wherein said bracing structure includes a spaced plurality of axially elongated ribs.

27. The foam dam of claim 26 wherein axially outer end portions of adjacent pairs of said ribs are joined to formed locking recesses, and said outer section has axially inwardly projecting tab structures snap-fittingly receivable in said locking recesses.

28. The foam dam of claim 26 wherein said ribs include first and second ribs disposed on opposite side wall portions of said inner section, and said inner section further includes an elongated handle structure longitudinally extending between and intersecuring axially outer end portions of said first and second ribs.

29. The foam dam of claim 28 wherein said outer section has an elongated cross member extending across its open outer side, said cross member being interlockable with said handle structure.

30. The foam dam of claim 29 wherein said handle structure has an axially outer side rib receivable in an inner side recess formed on said cross member.

* * * * *